US005140291A

United States Patent [19]

Mulder et al.

[11] Patent Number: 5,140,291

[45] Date of Patent: Aug. 18, 1992

[54] INDUCTIVE DEVICE

[75] Inventors: Stephanus A. Mulder; Paul N. Faase; Johannes H. Tobben; Eelco G. Visser, all of Eindhoven, Netherlands

[73] Assignee: U.S. Philips Corporation, New York, N.Y.

[21] Appl. No.: 568,003

[22] Filed: Aug. 16, 1990

[30] Foreign Application Priority Data

Aug. 22, 1989 [NL] Netherlands ..... 8902111

[51] Int. Cl.[5] ..... H01F 27/24; H01F 27/30

[52] U.S. Cl. ..... 336/198; 336/212; 336/233

[58] Field of Search ..... 336/198, 208, 83, 212, 336/233, 234

[56] References Cited

U.S. PATENT DOCUMENTS 4,352,081 9/1982 Kijima ..... 336/198
4,424,504 1/1984 Mitsui et al. ..... 336/83
4,760,366 7/1988 Mitsui ..... 336/198

FOREIGN PATENT DOCUMENTS 55-12721 1/1980 Japan ..... 336/83

*Primary Examiner*—Thomas J. Kozma
*Attorney, Agent, or Firm*—Leroy Eason

[57] ABSTRACT

An inductive device comprises a soft magnetic core which consists of two E-shaped core halves (1), each of which comprises three parallel limbs (5, 7) which are interconnected by a yoke (9). The core halves (1) are arranged against one another by way of the free ends of the limbs (5, 7), a coil former (3) being provided around the central limbs (7). The outer limbs (5) extend between an upper boundary plane (25) and lower boundary plane (27), which planes extend parallel to the longitudinal directions of the limbs (5, 7) and the yokes (9), the distance between said planes being determined by the height (x) of the outer limbs (5) which is greater than the height (y) of the central limbs (7). The lower boundary of the central limb (7) is situated above or below the boundary plane (27) a distance such that the symmetry plane (31) of the central limbs (7) which extends parallel to the boundary planes (25, 27), is situated halfway between the upper boundary plane (25) and a plane (33) which extends parallel to the boundary planes and is from 0.1 to 1 mm above the lower boundary of the coil former (3). A winding (29) provided on the coil former (3) occupies exactly the space between the upper side of the outer limits (5) and the lower side, thus minimizing the height of the device. Such device may be, for example, a transformer or a choke coil.

5 Claims, 2 Drawing Sheets

INDUCTIVE DEVICE

BACKGROUND OF THE INVENTION

1. Field of the Invention

The invention relates to an inductive device, comprising a soft magnetic core which consists of two E-shaped core halves, each of which comprises three parallel limbs which are interconnected by a yoke. The core halves are arranged one against the other by way of the free ends of the limbs, the central limbs being surrounded by a coil former on which a winding is provided. The outer limbs extend between an upper boundary plane and a lower boundary plane, which boundary planes extend parallel to the longitudinal directions of the limbs and the yokes. The distance between the boundary planes is determined by the dimension of the outer limbs in the direction perpendicular to the boundary planes, that being the height of the outer limbs, which height is greater than the height of the central limbs. The central limbs have a symmetry plane extending parallel to the boundary planes.

The inductive device can be, for example a transformer or a choke coil.

2. Description of the Related Art

A transformer of this kind is known from U.S. Pat. No. 4,760,366. Such transformers are intended particularly for mounting on a printed circuit board, the boundary planes then extending parallel to the plane of the board. The lower boundary plane is then formed by the boundary plane nearest to the board. The coil former may be provided with a connection strip with connection pins which are connected to lead-outs of the winding and which project below the lower boundary plane in a direction perpendicular to the boundary planes. The lower boundary of the coil former then rests against the surface of the board. The reason the height of the central limb is smaller than the height of the outer limbs is that the structural height of the core may then be smaller than in conventional E-cores. This is important because printed circuit boards are often mounted one over the other and the distance between neighbouring boards must then be as small as possible, for example 25.4 mm. Because the transformer is often the largest (highest) component on such a board, its height must be as small as possible.

SUMMARY OF THE INVENTION

It is an object of the invention to provide a transformer of the kind set forth whose structural height may even be smaller than that of the known transformer, for example 12.5 mm or less. To achieve this, the transformer in accordance with the invention is characterized in that the lower boundary of the central limb is situated above or below the lower boundary plane a distance such that the symmetry plane of the central limbs is situated halfway between the upper boundary plane and a plane which extends parallel to the boundary planes and which is situated from 0.1 to 1 mm above the lower boundary of the coil former.

The invention is based on the recognition of the fact that a further reduction of the structural height of the known transformer can be achieved only by reducing the height of the soft magnetic yoke and/or the coil former. However, a reduction of the height of the yoke or the coil former reduces the winding space available above or below the central limb, respectively, so that a part of the available overall winding space is not used.

The winding space thus lost increases the structural height of the transformer. In a transformer in accordance with the invention, the central limb is shifted in the vertical direction with respect to the yoke (and with respect to the coil former), so that substantially the same winding space is still available in all directions and this space can be completely filled. The magnitude of the winding space is determined by the distance between the upper boundary plane of the core and the upper boundary of the central limb. This distance can be comparatively arbitrarily chosen by the designer, after which the dimensions of the coil former can be selected in order to achieve the arrangement proposed by the invention. The distance between the lower boundary of the central limb and the lower boundary plane preferably amounts to at least 0.2 mm.

The lateral dimensions of the winding space are determined by the distance between the facing side faces of the central limbs and the outer limbs. It is desirable to minimize this distance in order to minimize the quantity of core material used and to minimize the surface area occupied by the transformer on the board. On the other hand, this distance should be large enough so that a coil former provided with a winding can be readily slid onto the central limb. To achieve this, a preferred embodiment of the transformer in accordance with the invention is characterized in that the distance between facing side faces of the central limbs and the outer limbs is from 0.1 to 0.2 mm greater than the distance between the upper side of the central limb and the upper boundary plane. The clearance of from 0.1 to 0.2 mm suffices for easy sliding of the coil former with the winding onto the central limb, the increase of the width of the transformer due to the introduction of this clearance being negligibly small.

BRIEF DESCRIPTION OF THE DRAWINGS

These and other aspects of the invention will be described in detail hereinafter with reference to the accompanying drawings in which.

DESCRIPTION OF THE PREFERRED EMBODIMENTS

Figure 1:
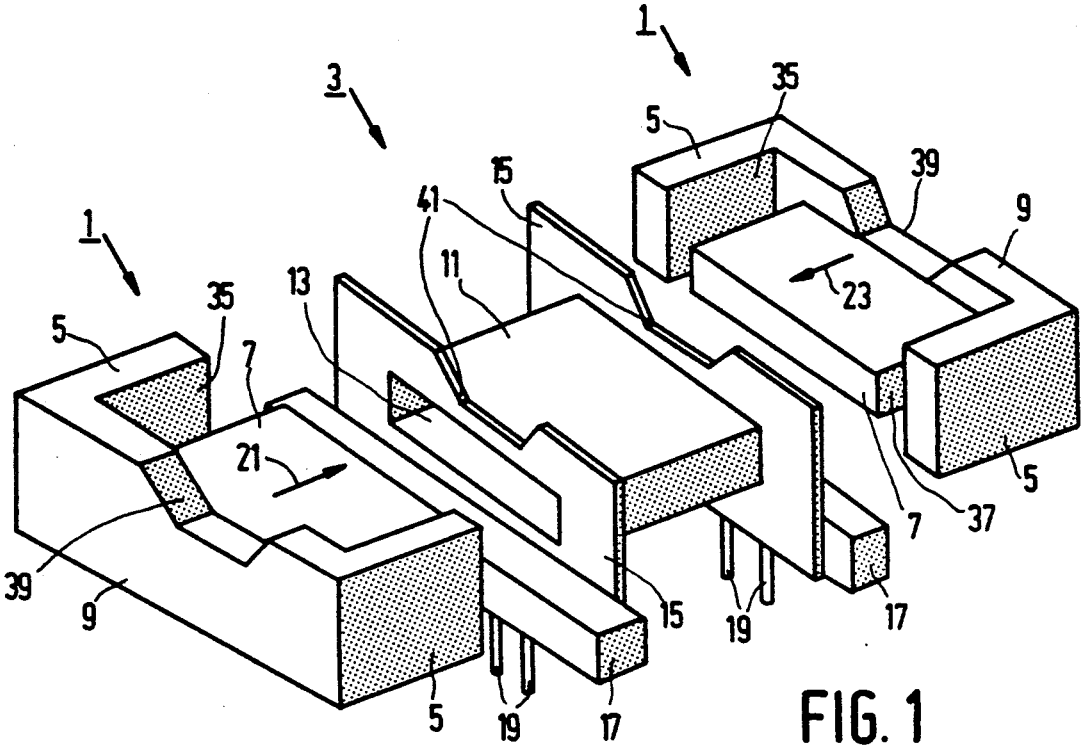
FIG. 1 is an exploded view of a coil former comprising two core halves for use in a first embodiment of a transformer in accordance with the invention.

FIG. 1 is an exploded view of two identical core halves 1 and a coil former 3. The core halves 1 are made of soft magnetic material, for example ferrite. They are shaped approximately as a E with two outer limbs 5 and a central limb 7. The three limbs 5, 7 extend in parallel and are interconnected by way of a yoke 9 which extends perpendicularly to the limbs. The coil former 3 comprises a tubular central portion 11 with a throughcavity 13, the cross-sectional shape of which corresponds to the cross-section of the central limbs 7. At the two ends of the central portion 11 there are provided two flanges 15 which extend perpendicularly to the longitudinal axis of the central portion and which support connection strips 17 at their lower side. The coil former is formed as an integral unit of a suitable, electrically insulating plastics, for example by injection moulding. The connection strips 17 are provided with metal connection pins 19. During the manufacture of the transformer a transformer winding consisting of a number of coils (not shown in FIG. 1) is provided on the central portion 11 between the flanges 15. For the manufacture of, for example, a choke coil, it suffices to use a winding consisting of a single coil. Subsequently, the central limbs 7 of the two core halves 1 are slid into the cavity 13 in the direction of the arrows 21, 23 until the free ends of the corresponding limbs of the two core halves contact one another. The core halves 1 are fixed in this position, for example by means of glue or resilient means (not shown).

Figure 2:
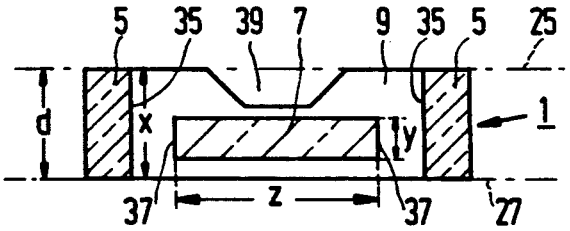
FIG. 2 is a cross-sectional view of one of the core halves shown in FIG. 1.
Figure 3:
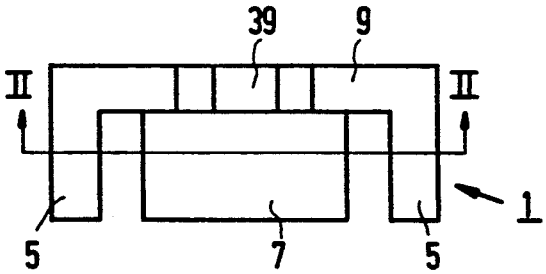
FIG. 3 is a plan view of the core half shown in FIG. 2.

FIGS. 2 and 3 show one of the core halves 1 in a cross-sectional view and a plan view, respectively. The outer limbs 5 of each core half 1 extend between an upper boundary plane 25 and a lower boundary plane 27. These boundary planes are denoted by strokes/dot lines in FIG. 2. The upper boundary plane 25 extends parallel to the longitudinal direction of the limbs 5, 7 and the yoke 9 and its position is determined by the upper side of the outer limbs 5. The lower boundary plane 27 extends parallel to the upper boundary plane 25 and its position is determined by the lower side of the outer limbs 5. The distance d between the two boundary planes 25, 27 is, therefore, determined by the height x of the two outer limbs 5, that is to say by their dimension perpendicular to the boundary planes. Because the two core halves 1 are identical, the upper boundary planes 25 coincide after assembly of the transformer, like the two lower boundary planes 27. It is to be noted that only a relative meaning is to be attached to terms such as "upper", "lower" and "height" in the present context. The lower side of the transformer is assumed to be the side which is intended to face the board when such a transformer is mounted on, for example a printed circuit board. In the present embodiment this is the side where the contact strips 17 are situated. Therefore, the "lower side of the transformer" remains the same when the transformer is mounted in a position other than the position shown, for example in a vertical position.

FIG. 3 shows that the length of the three limbs 5, 7 is the same, so that the ends of the limbs of the two core halves simultaneously contact one another when the core halves are slid into the cavity 13 by way of the central limbs 7. If the core is to comprise an air gap, the length of the central limbs 7 can be chosen to be slightly smaller than the length of the outer limbs 5. FIG. 2 shows that the height y of the central limb 7 is smaller than the height x of the outer limbs 5 and that the height y of the central limb is smaller than the width z of the central limb.

Figure 4:
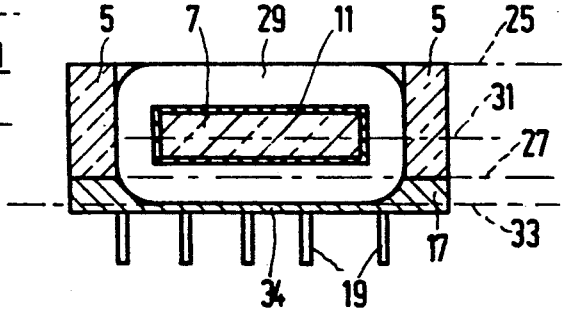
FIG. 4 is a diagrammatic cross-sectional view of the complete first embodiment.

FIG. 4 is a cross-sectional view, corresponding to FIG. 2, of the complete transformer with a winding 29 arranged around the central portion 11 of the coil former 3. The central limb 7 has a symmetry plane 31 which extends parallel to the boundary planes 25, 27 and which is situated halfway between the upper boundary plane 25 and a plane 33 which extends parallel to the boundary planes and which is situated from 0.1 to 1 mm above the lower boundary 34 of the coil former 3. In the embodiment shown the lower boundary 34 of the coil former 3 coincides with the lower side of the contact strip 17. It is also possible to provide the lower side of the contact strips 17 with projections whose lower side define the lower boundary 34 (not shown). Preferably, the distance between the plane 33 and the lower boundary 34 of the coil former 3 amounts to 0.5 mm. The planes 31 and 33 are denoted by stroke/dot lines in FIG. 4. The lower boundary of the central limb 7 is situated above the lower boundary plane 27 as shown in FIG. 2. This distance preferably amounts to at least 0.2 mm and can be chosen to be larger (up to approximately 2 mm), depending on the dimensions of the core and the winding space required. Thanks to the described construction, the winding 29 extends between the planes 25 and 33 and substantially completely fills the space available at the upper and the lower side. Thus, substantially no space which would increase the overall height of the transformer remains above and below the winding 29. The distance of from 0.1 to 1 mm existing between the plane 33 and the lower side 34 of the coil former 3 is necessary to maintain, after the mounting of the transformer on a printed circuit board, some clearance between this board and the winding 29 in order to allow air to flow around the winding for cooling purposes. This is because the lower side 34 of the coil former is generally mounted against the board.

The distance between the side faces 35 of the outer limbs 5 and the side faces 37 of the central limb 7 facing the side faces of coil former 3 is from 0.1 to 0.2 mm larger than the distance between the upper side of the central limb and the upper boundary plane 25. Consequently, between the central limb 7 and the outer limbs 5 exactly enough clearance exists to enable easy sliding of the coil former 3 with the winding 29 onto the central limb. If this clearance were greater, the space would no longer be completely filled by the winding 29, so that the transformer would be unnecessarily wide. As a result, more material would be required for the formation of the core and the transformer would occupy a larger surface area on a printed circuit board.

Because the winding 29 fills the available space substantially completely, hardly any room exists above and below this winding for guiding lead out wires from the winding to the connection pins 19. Therefore, approximately halfway across the yoke 9 a recess 39 is provided at the upper side wherethrough the lead out wires (not shown) can be guided. Corresponding recesses 41 are provided at the upper side of the flanges 15.

Figure 5:
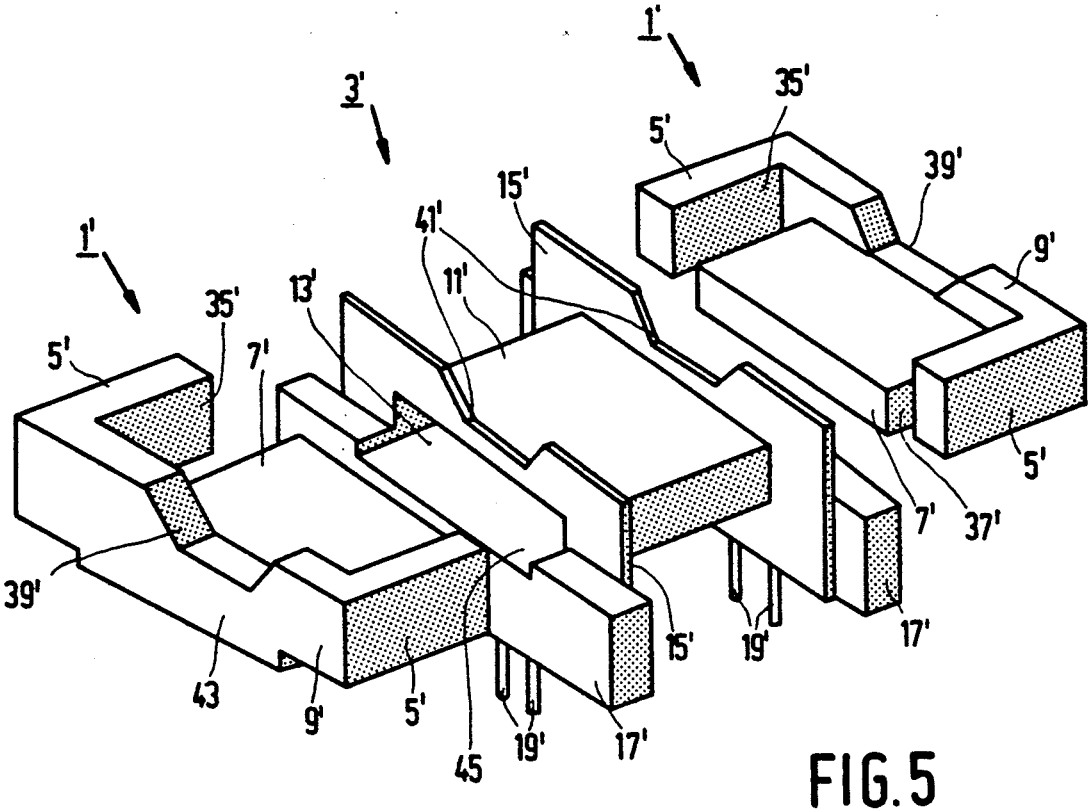
FIG. 5 is a view, corresponding to FIG. 1, of components for a second embodiment of a transformer in accordance with the invention.
Figure 6:
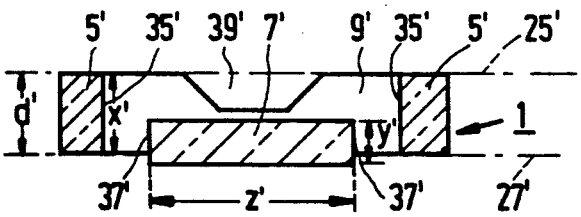
FIG. 6 is a cross-sectional view, corresponding to FIG. 2, of a core half for the second embodiment.
Figure 7:
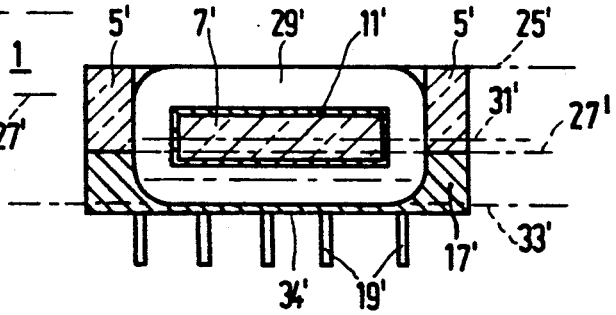
FIG. 7 is a cross-sectional view, corresponding to FIG. 4, of the second embodiment.

The FIGS. 5 to 7 show a second embodiment of a transformer in accordance with the invention. Elements in these Figures which correspond to elements of the first embodiment are denoted by the same reference numerals as used in the FIGS. 1, 2 and 4, but are provided with an accent.

The major difference with respect to the first embodiment consists in that the lower boundary of the central limb 7' is situated below the lower boundary plane 27' instead of above this plane (see FIG. 6). In this case the distance may again amount to from 0.2 to 2 mm. The height x' of the outer limbs 5' is smaller than the height x in the first embodiment. The height of the connection strips 17' is greater accordingly, so that in the second embodiment the symmetry plane 31' is also situated halfway between the upper boundary plane 25' and the plane 33' which extends parallel to the boundary planes 25', 27' and which is situated from 0.1 to 1 mm above the lower boundary 34' of the coil former 3'. As is clearly shown in FIG. 7, the winding 29' substantially completely fills the space available between the planes 25' and 33' also in the second embodiment.

FIG. 5 shows that the central limb 7' comprises a portion 43 which is situated below the yoke 9' and the outer limbs 5'. At the top centre the connection strips 17' are provided with a recess 45 in order to prevent the cavity 13' from being partly closed due to their large height.

The two embodiments described demonstrate that the designer of a transformer in accordance with the invention has a high degree of freedom as regards the choice of the shape of the core halves. As a result, the transformer can be comparatively readily adapted to the requirements imposed by different applications.

We claim:

1. An inductive device, comprising a soft magnetic core which consists of two E-shaped core halves (1), each of which comprises three parallel rectangular limbs (5, 7) which are interconnected by a yoke (9), which core halves are arranged one against the other by way of the free ends of the limbs, the central limbs (7) extending within a rectangular coil former (3) on which a winding (29) is provided, the coil former (3) having connection strips (17) thereon the lower surfaces of which define a lower boundary (34) of the device, the outer limbs (5) extending between an upper boundary plane (25) and a lower boundary plane (27), the lower boundary plane (27) being above the boundary (34), and the upper and lower boundary planes extending parallel to the longitudinal directions of the limbs and the yokes; the distance (d) between the boundary planes being determined by the height (x) of the outer limbs in a direction perpendicular to the boundary planes, which height (x) is greater than the height (y) of the central limbs, the central limbs (7) having a symmetry plane (31) extending parallel to the boundary planes; characterized in that the lower surfaces of the central limbs (7) are in a plane which is at a distance from the lower boundary plane (27) such that the symmetry plane (31) of the central limbs (7) is situated halfway between the upper boundary plane (25) and a plane (33) which extends parallel to the boundary planes (25, 27) and is situated from 0.1 to 1 mm above the lower boundary (34) of the device.

2. A device as claimed in claim 1, characterized in that the distance between the lower boundary of the central limbs (7) and the lower boundary plane (27) amounts to at least 0.2 mm.

3. A device as claimed in claim 1, characterized in that the distance between facing side faces (35, 37) of the central limbs (7) and the outer limbs (5) is from 0.1 to 0.2 mm greater than the distance between the upper side of the central limb and the upper boundary plane (25).

4. An inductive device as claimed in claim 2, characterized in that the distance between facing side faces (35, 37) of the central limbs (7) and the outer limbs (5) is from 0.2 to 0.2 mm greater than the distance between the upper sides of the central limbs (7) and the upper boundary plane (25).

5. An inductive device as claimed in claim 1, wherein said winding (29) substantially entirely occupies the space between the upper boundary plane (25) and said plane (33), thereby minimizing the height of said device for a given size of said winding (29).

* * * * *